United States Patent [19]

Kocsak

[11] 3,951,369

[45] Apr. 20, 1976

[54] IRON HOLDER

[76] Inventor: Dezso Kocsak, 7420 Eastmoreland Road, Annandale, Va. 22003

[22] Filed: Mar. 12, 1975

[21] Appl. No.: 557,516

[52] U.S. Cl. ..... 248/117.6; 38/142

[51] Int. Cl.[2] ..... D06F 79/02

[58] Field of Search ..... 38/103, 142; 248/117.2, 248/117.4, 117.6, 117.7

[56] References Cited

UNITED STATES PATENTS

| | | | |
|---|---|---|---|
| 2,108,581 | 2/1938 | Duffy | 38/142 |
| 3,204,903 | 9/1965 | Stoddard | 248/117.6 |
| 3,426,990 | 2/1969 | Pady | 248/117.6 |

*Primary Examiner*—Patrick D. Lawson

*Attorney, Agent, or Firm*—Dressler, Goldsmith, Clement & Gordon, Ltd.

[57] ABSTRACT

An iron holder is constituted by a U-shaped body of open-work material having a generally flat bottom and inwardly extending curved side walls adapted to enclose the iron while limiting engagement therewith to the edges of the sole plate, and a support is secured to the lower end of the body to carry a bracket which extends beneath the ironing board to secure the holder to the board with the body of the holder extending vertically above the board.

6 Claims, 3 Drawing Figures

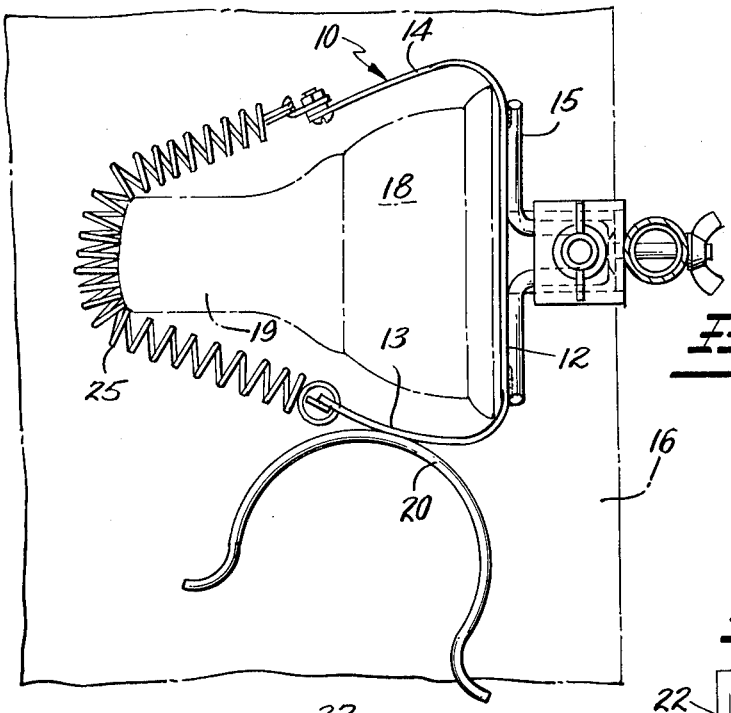
Fig. 2.
Fig. 1.
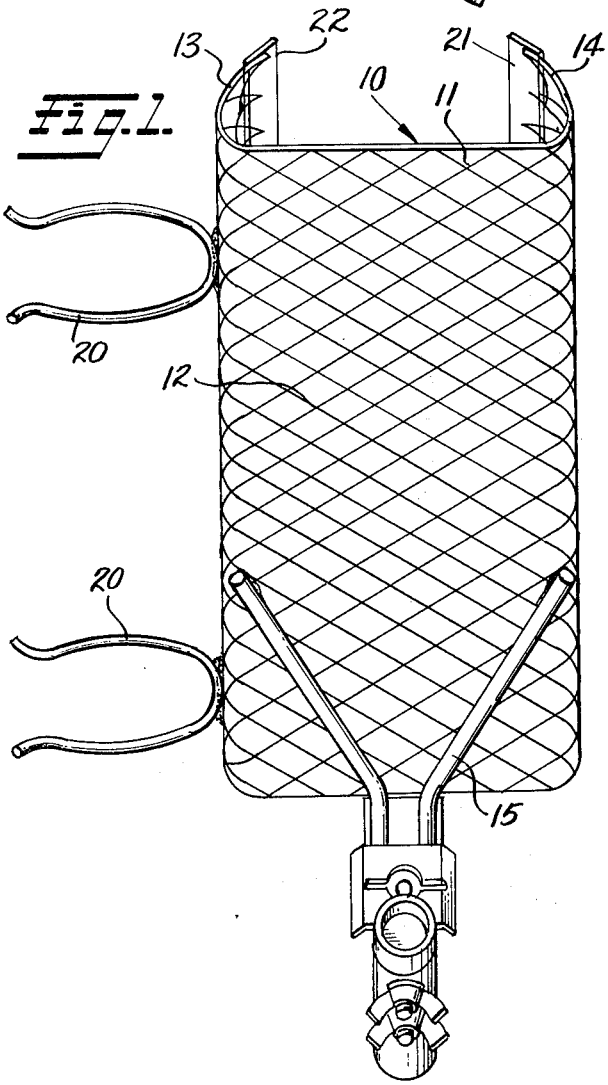
Fig. 3.
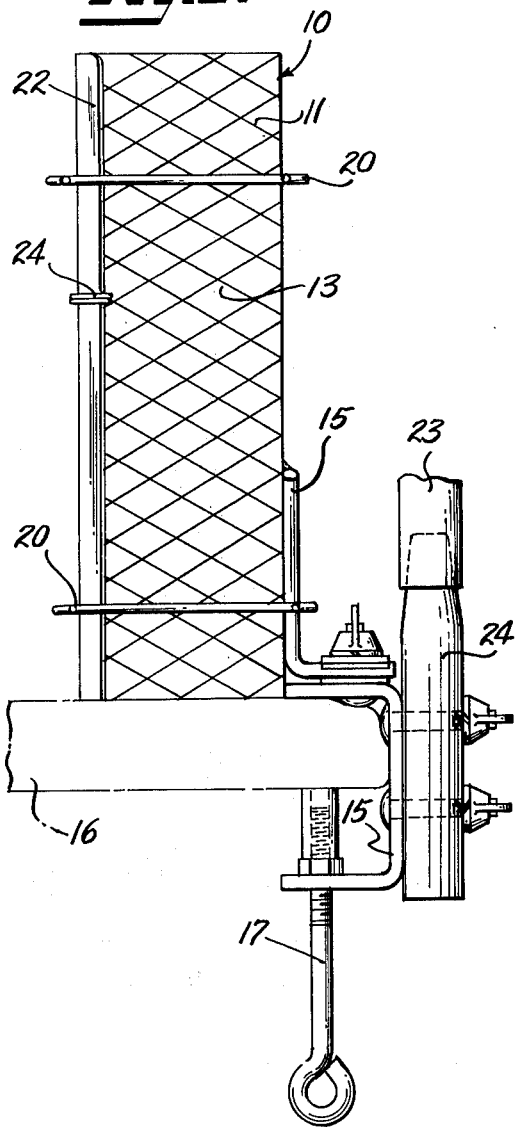

IRON HOLDER

Reference is made to Disclosure Document 028,622 dated Feb. 19, 1974.

This invention relates to a simple structure which is secured to the conventional ironing board to safely hold a hand iron in a manner permitting quick and easy access thereto. As a feature of the invention, the holder includes means for supporting ancillary items, particularly a spray container for water, starch or the like, and also for holding the ironed clothes. In this way, the heated iron is safely stored and readily accessible, and auxiliary items, and even the hanging of the ironed items are conveniently at hand, and the ironer does not have to move to complete the ironing task.

In accordance with this invention, an iron holder is constituted by a U-shaped body of open-work material having a generally flat bottom and inwardly extending curved side walls adapted to enclose an iron, the curvature of the side walls forcing any engagement with the iron to be limited to the edges of the sole plate thereof. A support is secured to the lower end of the body and this support carries a bracket which extends beneath the body when the body is stood on one end with the body and the sidewalls being vertically positioned. Means are then provided which coact with the bracket to secure the holder to an ironing board with the body of the holder extending vertically above the board.

With respect to ancillary items, a holder for a container is mounted on one of the side walls of the body, and a clothes hanger may be secured to the body, particularly by having it carried by the mounting bracket. Also, a spring may be secured to one of the side walls to extend across the opening in the body to releasably engage the other of the side walls when it is desired to secure the iron for storage.

The invention will be more fully understood from a description of the accompanying drawings in which:

FIG. 1 shows the holder in perspective looking from a point above and to the rear of the holder;

FIG. 2 is a top plan view showing an iron in phantom being safely stored with the holder; and FIG. 3 is a side elevation more fully showing the securement to an ironing board.

Referring to the drawings, the holder 10 has a body 11 of open-mesh material such as metal lath, to enable the heat of the iron to be dissipated. The body 11 is U-shaped with a generally flat bottom 12 and inwardly extending curved side walls 13 and 14. This U-shaped body 11 is stood on one end with the bottom 12 and the side walls 13 and 14 extending vertically as pictured and one or more supports 15 are secured as by welding to the lower portion of the bottom 12. The support 15 is bent or secured to another element to provide a bracket which extends beneath the structure as is most easily seen in FIG. 3 where the manner of installation will be clear from the phantom ironing board 16 which extends beneath the body 11 and above the bracket extension of support 15 where it is grasped by the wing bolt 17 carried by the bracket extension.

The manner in which the iron is safely supported will now be apparent from FIG. 2 where the iron is shown in phantom at 18. As can be seen, the iron is lowered into place using its handle 19 and, in its lower position on the board 16, the iron cannot fall over being retained within the inwardly extending side walls 13 and 14. These side walls are curved so that contact with the iron is limited to the edges of the sole plate of the iron.

Wires to straps 20 are secured in any desired manner, as by welding or crimping to one or more of the sidewalls 13 or 14. Two wires are shown here, and these provide a receptacle into which a container such as a bottle or spray can may be placed for convenience. The container, like the iron, is stored and reacquired for use by a vertical movement which cannot occur accidentally.

The terminating edges of the sidewalls 13 and 14 may be reinforced by straps 21 and 22 to cover the unfinished edges of the metal lath used to constitute the body of the holder.

A hanger 23 for ironed clothes may be secured to the bracket 15, as shown, via a tubular piece 24. The details of the hanger 23 are not shown, but interfit between the tube 24 and the hanger 23 can be seen in the drawing.

Clothes hung on hanger 23 drape down below the level of the ironing board 16 since the hanger 23 is mounted beyond the end of the ironing board.

A coil spring 25 may be employed as indicated in FIG. 2 to hold the iron more securely for prolonged storage. Spring 25 is secured to one of the sidewalls and is releasably engaged with the other side wall. During the ironing operation, the spring 25 is moved out of the way and is not used.

The invention is defined in the claims which follow.

I claim:

1. An iron holder adapted to be releasably secured to an ironing board to safely store a heated iron ready for use comprising a U-shaped body of open mesh material having a generally flat bottom and inwardly extending curved side walls adapted to enclose an iron, a support secured to the lower end of said body, said support carrying a bracket which extends beneath said U-shaped body when the said body is stood on one end with the said body and said side walls being vertically positioned, and means coacting with said bracket for securing said holder to an ironing board when the holder is positioned with the body thereof extending vertically above the board and the bottom of the bracket extending below the board.

2. An iron holder as recited in claim 1 in which a holder for a container is mounted on one of the side walls of said body.

3. An iron holder as recited in claim 1 in which a clothes hanger is mounted on said bracket.

4. An iron holder as recited in claim 1 in which a spring is secured to one of said side walls and is adapted to be releasably secured to the other of said side walls to close the space therebetween.

5. An iron holder as recited in claim 1 in which the side walls are configured with respect to the iron to force engagement therebetween only with the edge of the sole plate of the iron.

6. An iron holder as recited in claim 1 in which said open work material is metal lath.

* * * * *